US006761424B2

(12) United States Patent
Murata

(10) Patent No.: US 6,761,424 B2
(45) Date of Patent: Jul. 13, 2004

(54) IMAGE PRINT APPARATUS AND CONTROL METHOD THEREOF

(75) Inventor: Takayuki Murata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/227,388

(22) Filed: Aug. 26, 2002

(65) Prior Publication Data

US 2003/0043218 A1 Mar. 6, 2003

(30) Foreign Application Priority Data

Aug. 31, 2001 (JP) ..... 2001-264670

(51) Int. Cl.[7] ..... B41J 29/38
(52) U.S. Cl. ..... 347/14; 347/57
(58) Field of Search ..... 347/14, 56, 57, 347/10, 17, 40

(56) References Cited

U.S. PATENT DOCUMENTS 4,151,558 A 4/1979 Manners
4,313,124 A 1/1982 Hara ..... 347/57
4,345,262 A 8/1982 Shirato et al. ..... 347/10
4,459,600 A 7/1984 Sato et al. ..... 347/47
4,463,359 A 7/1984 Ayata et al. ..... 347/56
4,558,333 A 12/1985 Sugitani et al. ..... 347/65
4,723,129 A 2/1988 Endo et al. ..... 347/56
4,740,796 A 4/1988 Endo et al. ..... 347/56
5,426,454 A * 6/1995 Hosono et al. ..... 347/9
5,896,146 A 4/1999 Murata et al. ..... 347/42
5,912,693 A * 6/1999 Katsuma et al. ..... 347/191
5,940,097 A 8/1999 Imai
6,199,969 B1 3/2001 Haflinger et al.

FOREIGN PATENT DOCUMENTS

EP 1 078 750 2/2001

* cited by examiner

*Primary Examiner*—Lamson D Nguyen
(74) *Attorney, Agent, or Firm*—Fitzpatrick, Cella, Harper & Scinto

(57) ABSTRACT

This invention provides an image print apparatus capable of quickly reducing, with a low-cost arrangement, charges accumulated in a capacitor used for reducing variations in printhead voltage, and a control method thereof. After a head power supply $V_H$ which supplies power to the printhead is turned off, the print element of the printhead is so driven as not to discharge ink.

20 Claims, 13 Drawing Sheets

FIG. 4

| BLOCK SIGNAL (BLE) | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| NOZZLE NUMBER OF PRINTHEAD | 0 | 1 | 2 | 3 | 4 | 5 | 6 | 7 | 8 | 9 | 10 | 11 | 12 | 13 | 14 | 15 |
| | 16 | 17 | 18 | 19 | 20 | 21 | 22 | 23 | 24 | 25 | 26 | 27 | 28 | 29 | 30 | 31 |
| | 32 | 33 | 34 | 35 | 36 | 37 | 38 | 39 | 40 | 41 | 42 | 43 | 44 | 45 | 46 | 47 |
| | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| | 240 | 241 | 242 | 243 | 244 | 245 | 246 | 247 | 248 | 249 | 250 | 251 | 252 | 253 | 254 | 255 |

IMAGE PRINT APPARATUS AND CONTROL METHOD THEREOF

FIELD OF THE INVENTION

The present invention relates to an image print apparatus, control method thereof, and storage medium and, more particularly, to an ink-jet print apparatus having a print element which can control a printhead at a stable voltage, a control method thereof, and a storage medium.

BACKGROUND OF THE INVENTION

A printer which prints desired information such as a character or image on a sheet-like print medium such as paper or film is proposed as an information output apparatus for a word-processor, personal computer, facsimile apparatus, and the like.

Various methods are known for use as the print method of the printer. In recent years, an ink-jet method has especially received a great deal of attention because this method can print information on a print medium such as a sheet in a non-contact manner, can easily print color information, and generates little noise. A general ink-jet arrangement adopts a serial print method because of easy reduction in cost and size. According to this method, a printhead which discharges ink in accordance with desired print information is mounted. The printhead prints information while being reciprocally scanned in a direction perpendicular to the feed direction of a print medium such as a sheet.

The ink-jet printer realizes high-definition, high-quality printing by decreasing the volume of ink droplets discharged from the nozzles of the printhead.

In order to decrease the volume of ink droplets and achieve high-speed printing, the drive voltage of a print element which causes each nozzle of the printhead to discharge an ink droplet must be controlled as stably as possible. For this purpose, e.g., an electrolytic capacitor is generally set as a means for reducing voltage variations near the printhead having the print element.

When the printhead is to be exchanged, a printhead drive voltage and logic drive voltage are so stopped as not to apply any power to the contact between the printhead and a carriage which holds the printhead in order to allow the user to safely exchange the printhead. Then, the printhead is moved to a printhead exchange position.

At this time, charges accumulated in the electrolytic capacitor near the printhead having the print element are removed. For this purpose, a discharge resistor and a switching unit such as a switch are arranged on the printhead, and charges accumulated in the electrolytic capacitor are removed using the discharge resistor. When the drive voltage is stopped, a line connected to the electrolytic capacitor is connected to the discharge resistor by the switching unit, and charges accumulated in the electrolytic capacitor are safely removed.

As printers become less expensive, the discharge resistor and switching unit, which increase the cost, are being eliminated from the printhead. Such a printhead does not have any discharge resistor which removes charges accumulated in the electrolytic capacitor. After charges accumulated in the electrolytic capacitor spontaneously disappear, the printhead is moved to a printhead exchange position.

However, the printhead equipped with no discharge resistor which removes charges accumulated in the electrolytic capacitor requires a longer spontaneous discharge time as the electrolytic capacitor has a larger capacitance. It takes a longer time than the conventional printhead to move the printhead to a printhead exchange position after the user presses the exchange start button of the printer in order to exchange the printhead. This leads to a long work time when the user exchanges the printhead.

SUMMARY OF THE INVENTION

The present invention has been made to overcome the conventional drawbacks, and has as its object to provide an image print apparatus capable of quickly reducing, with a low-cost arrangement, charges accumulated in a capacitor serving as a means for reducing variations in printhead voltage, and a control method thereof.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The invention will be better understood and its numerous objects and advantages will become more apparent to those skilled in the art by reference to the following drawings, in conjunction with the accompanying specification, in which:

FIG. 4 is a table showing the relationship between a block selection signal and a nozzle number in the printhead;

DETAILED DESCRIPTION OF THE PREFERRED EMBODIMENTS

An image processing system including an image processing apparatus and image print apparatus according to preferred embodiments of the present invention will be described below with reference to the accompanying drawings.

The following embodiments will exemplify an ink-jet printer as an image print apparatus, but do not limit the spirit and scope of the present invention to examples described below.

In the following description, the printhead of the ink-jet printer discharges ink to print an image. The present invention can also be applied to a case wherein an image is printed by a method of not discharging any ink as far as an image can be printed.

<First Embodiment>

Figure 1:
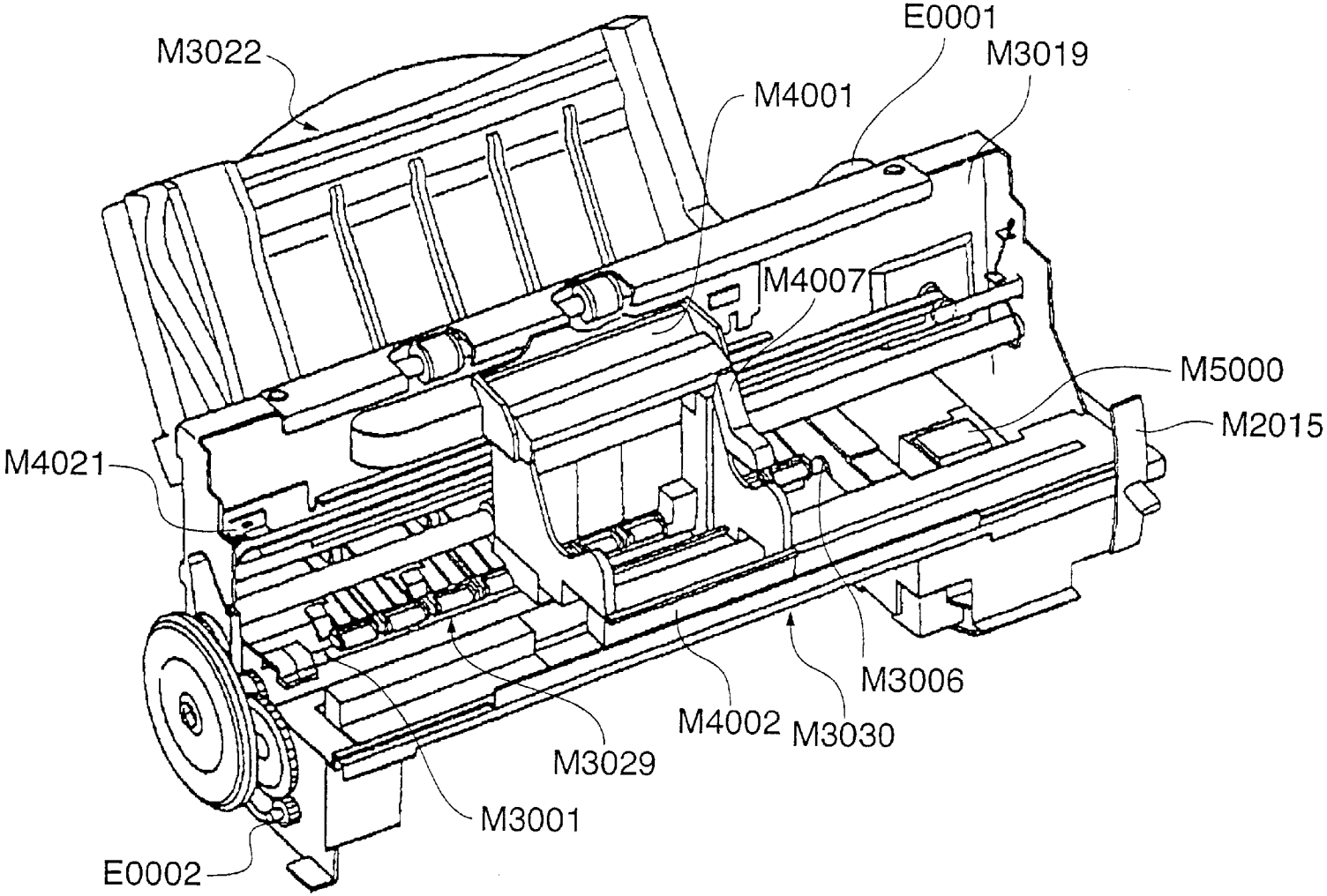
FIG. 1 is a view for explaining an arrangement of an ink-jet printer.

[Arrangement of Ink-Jet Printer: FIG. 1]

FIG. 1 shows the schematic arrangement of an ink-jet printer. The ink-jet printer comprises an automatic feeder section (M3022) which automatically feeds a print sheet into the ink-jet printer, a convey section (M3029) which guides print sheets fed one by one from the automatic feeder section to a desired print position and guides the print sheet from the print position to a discharge section (M3030), a print unit which performs desired printing on a print sheet conveyed to the convey section (M3029), and a recovery section (M5000) which executes recovery processing for the print unit and the like. The print unit is constituted by a carriage (M4001) movably supported by a carriage shaft (M4021), and a printhead cartridge (not shown) detachably mounted on the carriage (M4001).

Figure 2:
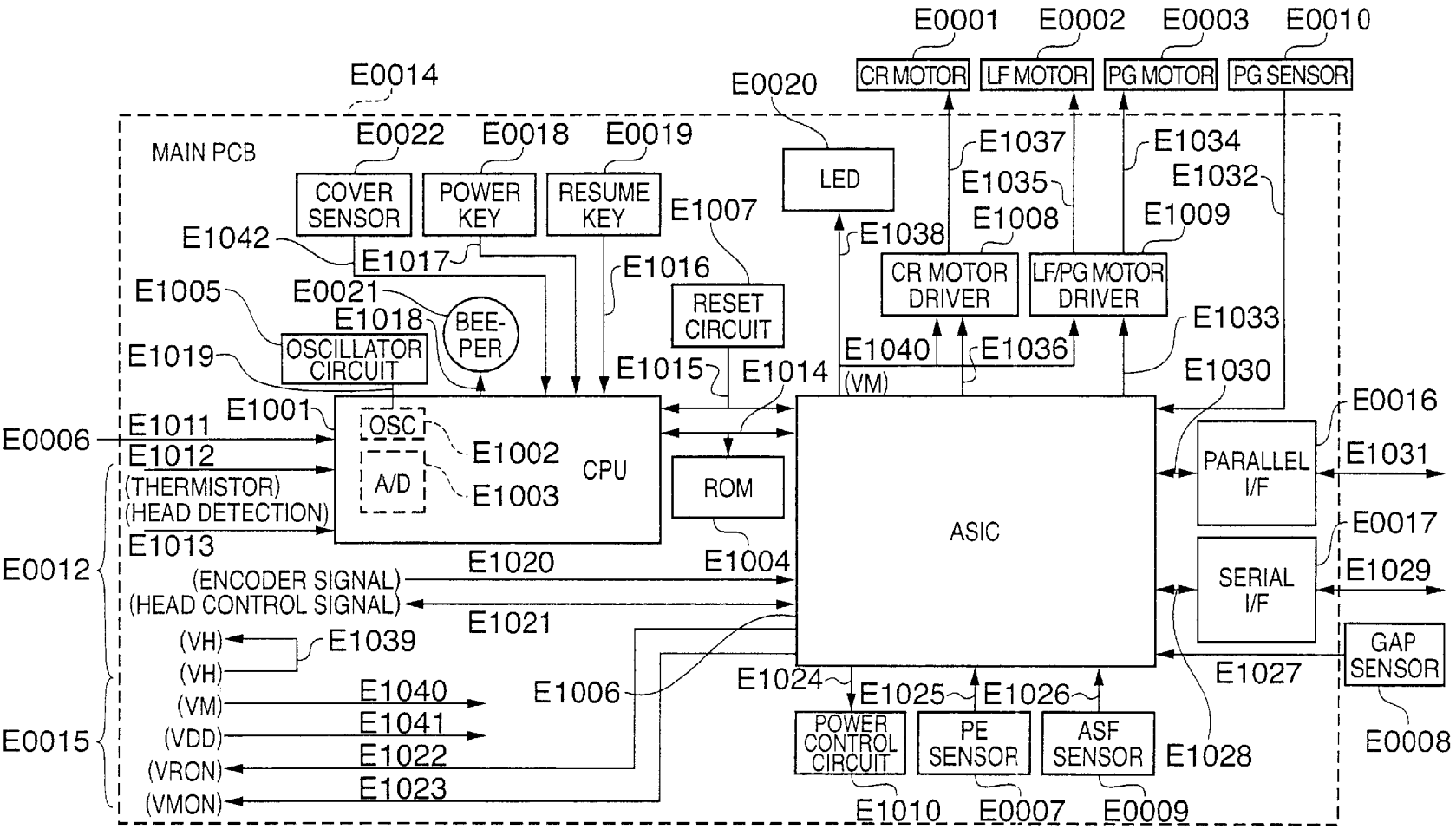
FIG. 2 is a block diagram showing the internal arrangement of a printed circuit board on which major electrical components of the ink-jet printer are mounted.

[Internal Arrangement of Printed Circuit Board: FIG. 2]

FIG. 2 is a block diagram showing the internal arrangement of a printed circuit board (E0014, main PCB: Main Printed Circuit Board) on which major electrical components are mounted.

In FIG. 2, a CPU (E1001) incorporates an oscillator OSC (E1002), is connected to an oscillator circuit (E1005), and generates a system clock in response to an output signal from the oscillator circuit (E1005).

The CPU (E1001) is connected to a ROM (E1004) and ASIC (E1006, Application Specific Integrated Circuit) via a control bus (E1014), and controls the ASIC in accordance with a program stored in the ROM. The CPU (E1001) detects the states of an input signal (E1017) from a power key, an input signal (E1016) from a resume key, a cover detection signal (E1042), and a head detection signal (E1013).

The CPU (E1001) drives a beeper (E0021) by a beeper signal (E1018), and detects the states of an ink end detection signal (E1011) and thermistor temperature detection signal (E1012) that are input to an internal A/D converter (E1003). Also, the CPU (E1001) performs various logical calculations and condition determination, and drives and controls the ink-jet printer.

The head detection signal (E1013) is a head mounting detection signal input from the printhead cartridge via a flexible flat cable, carriage board, and contact flexible cable. The ink end detection signal is an analog signal from a thermistor (not shown) arranged on the carriage board.

A CR motor driver (E1008) uses a motor power supply VM (E1040) as a drive source, generates a CR motor drive signal (E1037) in accordance with a CR motor control signal (E1036) from the ASIC (E1006), and drives a CR motor (E0001).

An LF/PG motor driver (E1009) uses the motor power supply (E1040) as a drive source, generates an LF motor drive signal (E1035) in accordance with a pulse motor control signal (E1033) from the ASIC (E1006), and drives the LF motor. At the same time, the LF/PG motor driver (E1009) generates a PG motor drive signal (E1034), and drives the PG motor.

A power control circuit (E1010) controls power supply to each sensor having a light-emitting element, and the like in accordance with a power control signal (E1024) from the ASIC (E1006). The power control circuit (E1010) transmits a parallel I/F signal (E1030) to an externally connected parallel I/F cable (E1031), and transmits a signal from the parallel I/F cable (E1031) to the ASIC (E1006).

A serial I/F (E0017) transmits a serial I/F signal (E1028) from the ASIC (E1006) to an externally connected serial I/F cable (E1029), and transmits a signal from the cable (E1029) to the ASIC (E1006).

A power supply unit (E0015) supplies a head power $V_H$ (E1039), the motor power VM (E1040), and a logic power VDD (E1041).

The power supply unit (E0015) receives a head power ON signal VRON (E1022) and motor power ON signal VMON (E1023) from the ASIC (E1006), and ON/OFF-controls the head power supply (E1039) and motor power supply (E1040).

The logic power (E1041) supplied from the power supply unit (E0015) is converted into a voltage, as needed, and supplied to respective portions inside and outside the main PCB (E0014).

The head power $V_H$ (E1039) is smoothed by the main PCB (E0014), sent to a flexible flat cable (E0012), and used to drive the printhead cartridge.

A reset circuit (E1007) detects a decrease in logic power supply voltage (E1041), supplies a reset signal (E1015) to the CPU (E1001) and ASIC (E1006), and initializes them.

The ASIC (E1006) is a semiconductor integrated circuit on one chip. The ASIC (E1006) is controlled by the CPU (E1001) via the control bus (E1014), outputs the CR motor control signal (E1036), LF/PG motor control signal (E1033), power control signal (E1024), head power ON signal VRON (E1022), motor power ON signal VMON (E1023), and the like, and exchanges signals with a parallel I/F (E0016) and the serial I/F (E0017). The ASIC (E1006) detects the states of a PE detection signal (E1025) from a PE sensor (E0007), an ASF detection signal (E1026) from an ASF sensor (E0009), a GAP detection signal (E1027) from a GAP sensor (E0008), and a PG detection signal (E1032) from a PG sensor (E0010). Then, the ASIC (E1006) transmits data representing the states of these signals to the CPU (E1001) via the control bus (E1014). The CPU (E1001) controls the driving of an LED drive signal (E1038) on the basis of the input data, and turns on/off an LED (E0020).

Further, the ASIC (E1006) detects the state of an encoder signal (E1020), and generates a timing signal and head control signal (E1021). The ASIC (E1006) interfaces with the printhead cartridge by the head control signal (E1021), and controls print operation. The encoder signal (E1020) is an output signal from a CR encoder sensor (not shown) input via the flexible flat cable (E0012).

The head control signal (E1021) is supplied to the printhead via the flexible flat cable (E0012), a carriage board (E0013), and a contact FFC (E0011). The printhead cartridge is made up of a printhead capable of printing information in a plurality of colors, and a plurality of color ink cartridge.

Figure 3:
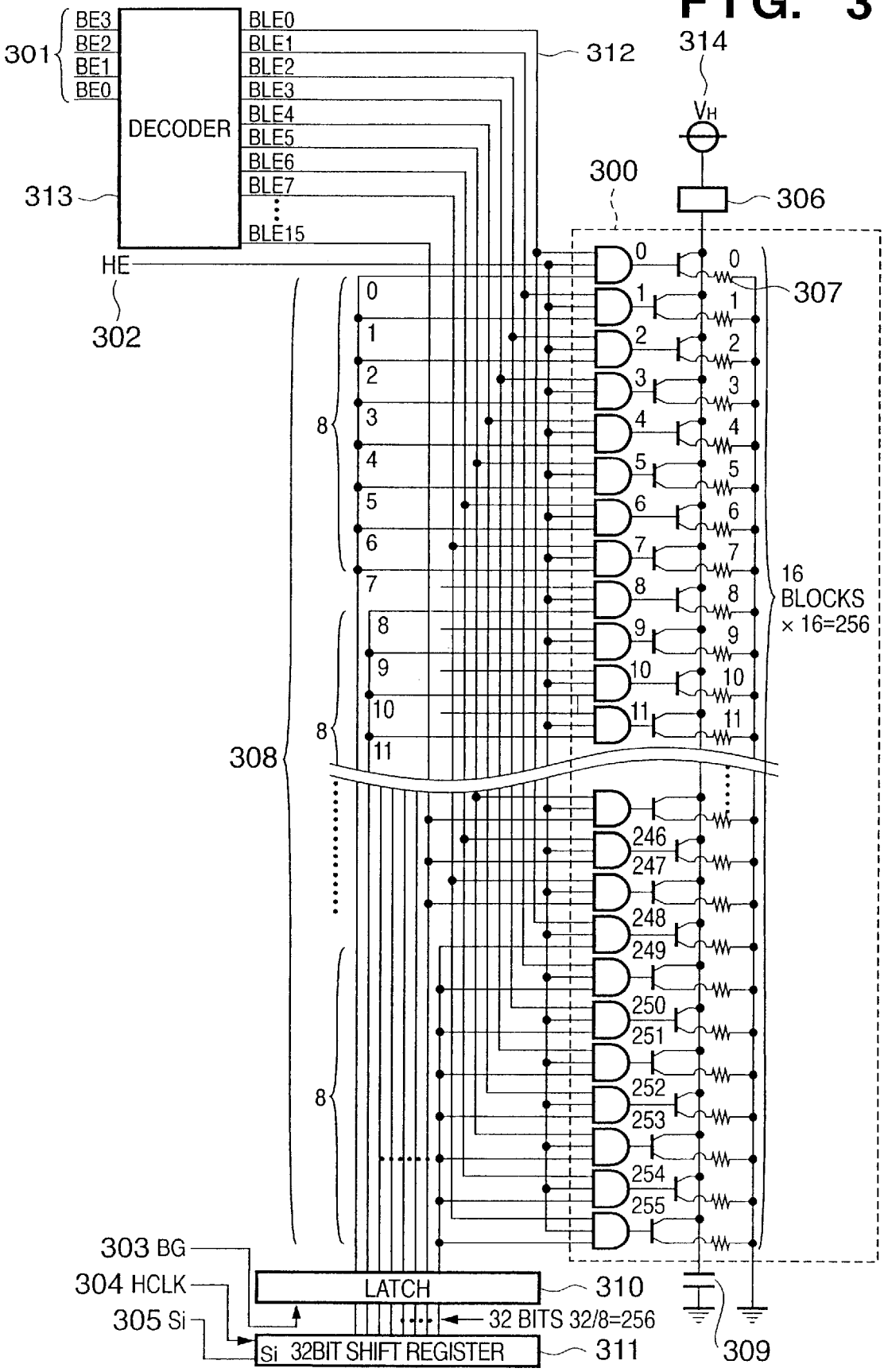
FIG. 3 is a circuit diagram showing the circuit arrangement of a printhead.

[Printhead Drive Circuit: FIG. 3]

Figure 5:
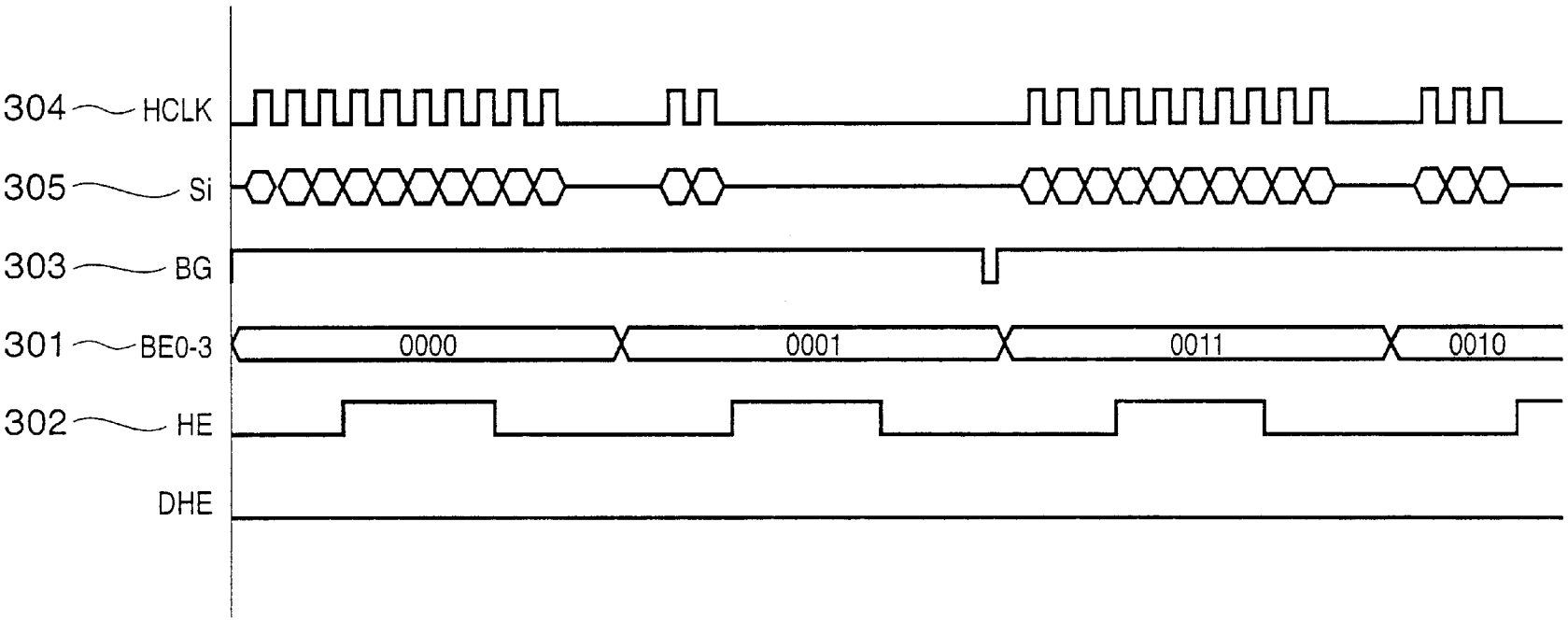
FIG. 5 is a timing chart showing the drive timing of a drive circuit.

FIG. 3 shows a drive circuit for driving the print elements (the electrothermal transducers) of the printhead for one color. FIG. 5 shows the drive timing of the drive circuit. This drive circuit is driven by the above-mentioned head control signal (E1021). The head control signal (E1021) contains a block enable signal 301 (BE), heat enable signal 302 (HE), bus grant signal 303 (BG), head transfer clock 304 (HCLK), and serial-in signal 305 (Si). The timings of these signals are shown in FIG. 5.

The printhead for one color has 256 nozzles acting as main orifices that are grouped into 16 by a 32-bit shift register 311 and four block enable signals 301. Each print element 307 is driven by a power transistor, generates heat to cause film boiling in ink stored in an ink chamber (ink channel) arranged in correspondence with the print element 307, and discharges ink from the nozzle as a main orifice.

Print data are serially transferred using the head transfer clock HCLK 304 serving as a transfer clock to the shift register, and the Si signal 305 serving as serial data to the shift register. The print data are latched by the bus grant BG signal 303 serving as a latch signal to a latch circuit 310, and nozzle selection signals 308 based on the print data are supplied to the print element side. Block selection signals 312 (BLE) are generated by decoding four block enable signals 301 (BE0, BE1, BE2, and BE3) into 16 signals by a decoder 313. The block selection signals 312 enable 16 groups of print elements, respectively. Discharge is controlled by ANDing the nozzle selection signals 308 based on print data, a selected block selection signal 312, and the heat enable signal 302 (HE).

The print elements 307 of the printhead are electrically connected to the block selection signals 312 BLE0, BLE1, BLE2, . . . , BLE15 sequentially from the first (0th) print element of the printhead. Subsequent print elements 307 are repetitively electrically connected to BLE0 to BLE15. As a result, the print elements 307 of the printhead at addresses 0, 16, 32, . . . , 240 are connected to BLE0. The remaining print elements are also sequentially connected to BLE1, BLE2, . . . , BLE15. A detailed connection correspondence between the print elements 307 and the block selection signals 312 is shown in FIG. 4.

Power is supplied to the printhead from the head power supply $V_H$ (E1039, 314) via a head power switch 306. The head power switch 306 is ON/OFF-controlled by the head power ON signal VRON (E1022).

Figure 6:
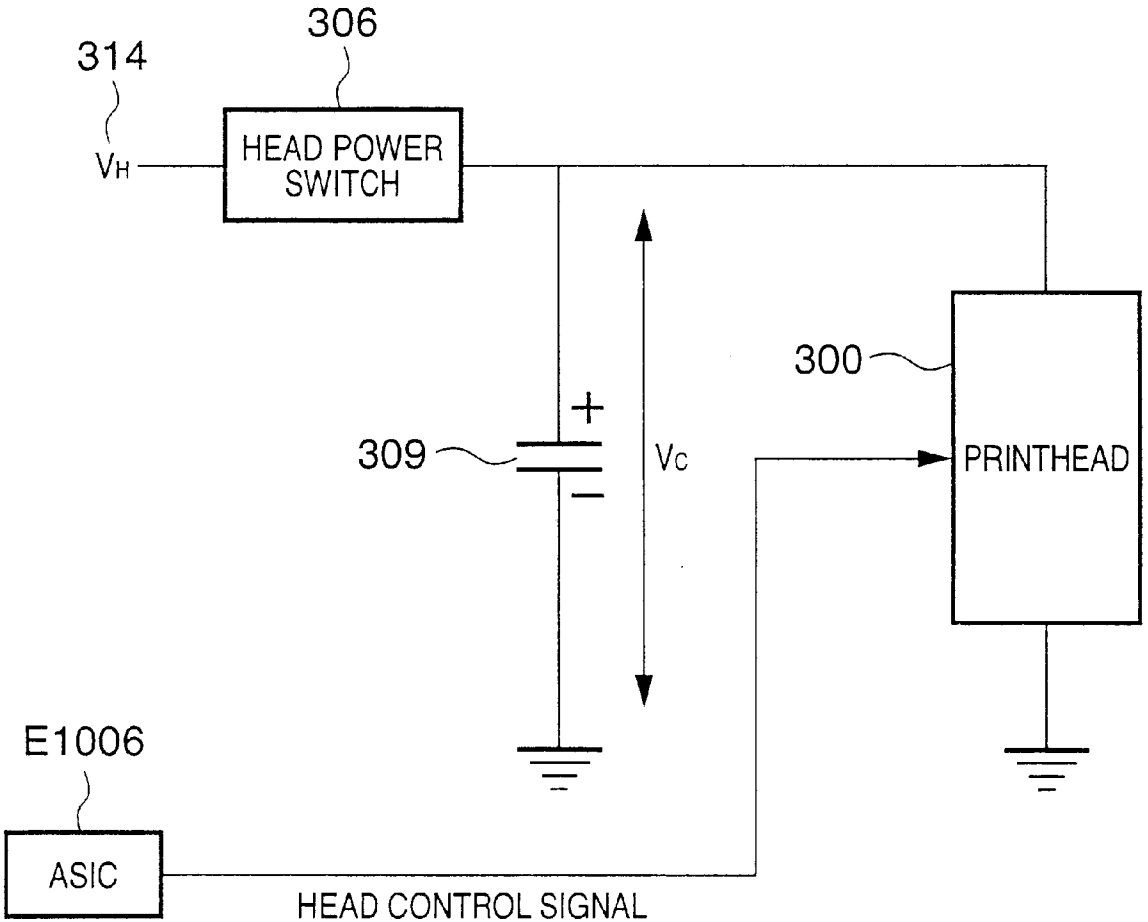
FIG. 6 is a block diagram for explaining an arrangement for reducing a capacitor voltage $V_C$ applied to the printhead in the first embodiment.

[Control of Variations in Printhead Drive Voltage: FIG. 6]

As shown in FIG. 6, the printhead controls discharge by turning on/off a head drive voltage applied to the printhead by using the head control signal (E1021) described with reference to FIG. 5. At this time, the head power switch 306 is ON. When the number of simultaneously driven print elements is large, a capacitor 309 such as an electrolytic capacitor with a relatively large capacitance is arranged on the printhead side (on the carriage or the like), as shown in FIG. 6. The capacitor 309 supplies a current to the print element, suppresses variations in head drive voltage ($V_H$) caused by simultaneous driving, and prevents any influence on the next driving.

Figure 7:
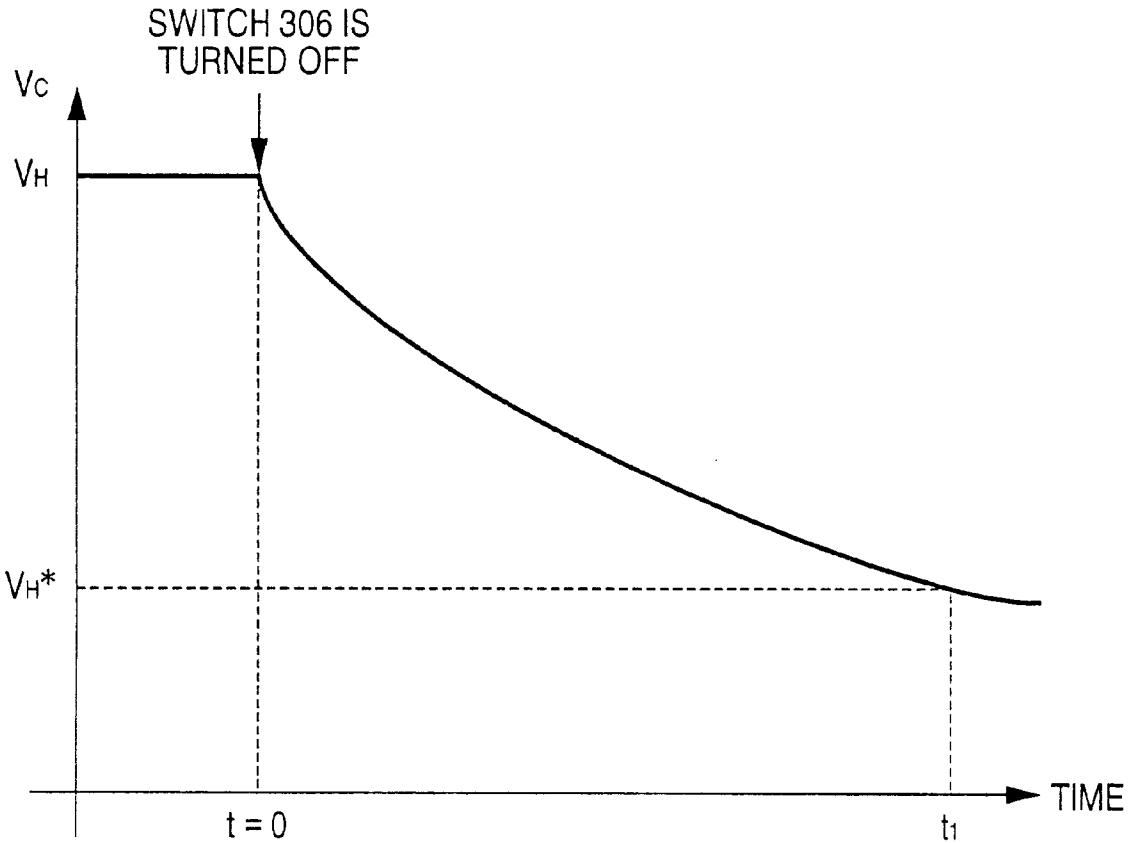
FIG. 7 is a graph for explaining the relationship between the capacitor voltage $V_C$ and the time when charges accumulated in a capacitor 309 spontaneously disappear.

In a printhead 300 shown in FIG. 6, a head power supply $V_H$ (314) is turned off during a series of sequences in turning off the power supply or exchanging the printhead. Considering repetitive printhead exchange or power ON/OFF operation, charges accumulated in the capacitor 309 are desirably removed within a short time. A low-cost ink-jet printer having a special discharge circuit as shown in FIG. 6 requires a long time ($t_1$) until a voltage $V_C$ of the capacitor 309 reaches a preset safe voltage ($V_H$*) by spontaneous discharge after the head power switch 306 is turned off, as shown in FIG. 7. (The period until $V_C$ drops to $V_H$* after turning off the head power switch 306 will be referred to as an OFF sequence hereinafter.)

Figure 8A:
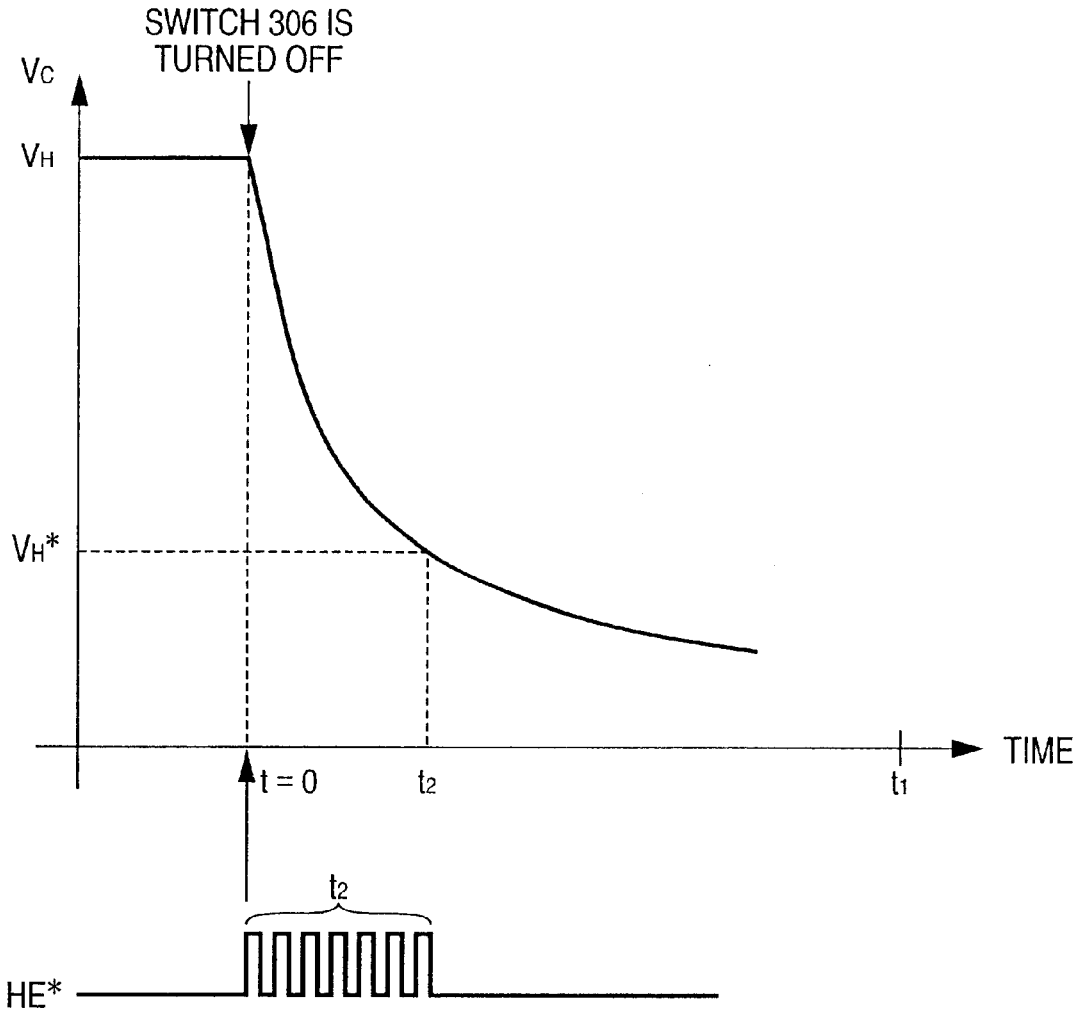
FIG. 8A is a graph for explaining the relationship between the capacitor voltage $V_C$ and the time when charges accumulated in the capacitor 309 are removed using a discharge circuit in the first embodiment.
Figure 8B:
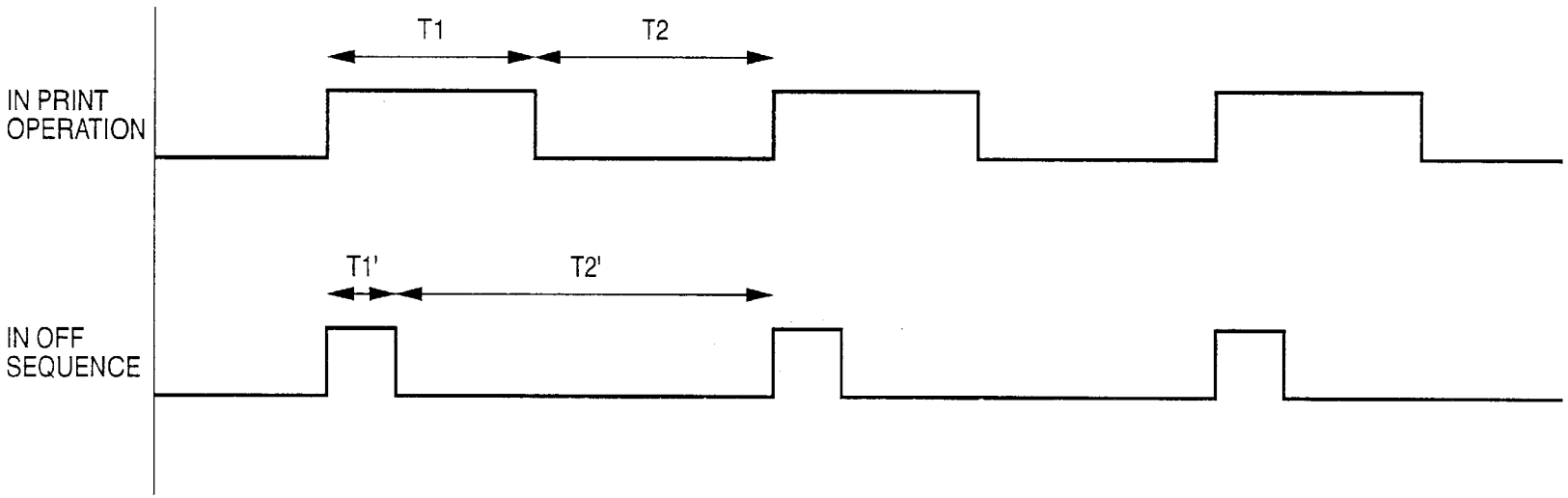
FIG. 8B is a timing chart for comparing heat enable signals in print operation and an OFF sequence in the first embodiment.

[Reduction in Drive Voltage After Supply of Drive Voltage Stops: FIGS. 8A and 8B]

In the first embodiment, the head control signal (E1021) for driving the print element 307 for a short time, as shown in FIG. 8A, is transmitted to the arrangement of the printhead shown in FIG. 6 after the head power switch 306 is turned off at the end of image printing. At this time, the print element 307 is driven while being adjusted such that driving of a print element used for printing does not discharge ink (electrical energy is converted into heat by using the electrothermal transducer). Even the ink-jet printer using the printhead 300 equipped with no special discharge circuit can quickly remove charges accumulated to the level of the head power supply $V_H$ in the capacitor 309, and can shorten the OFF sequence time ($t_1$>$t_2$).

In FIG. 8A, after the head power switch 306 is turned off, the head control signal (E1021) shown in FIG. 5 which is the same as that used for discharge is supplied to the printhead 300 for a preset control time (time $t_2$ shown in FIG. 8A or a predetermined number of pulses), thereby driving the printhead 300. The print element is driven using charges accumulated in the capacitor 309. As a result, charges accumulated in the capacitor 309 can be reduced using an electrothermal transducer serving as the print element (charges accumulated in the capacitor 309 are converted into heat).

In this case, the heat enable signal 302 (HE) which drives the print element may discharge ink if the heat enable signal 302 (HE) is given a pulse width necessary to discharge ink. To prevent this, the pulse width is set in advance so as not to discharge ink.

FIG. 8B shows a comparison between the pulse width of the heat enable signal 302 (HE) in the OFF sequence and the pulse width of this signal in print operation. In print operation 801, the heat enable signal 302 has a HIGH pulse width T1 and a LOW pulse width T2. In an OFF sequence 802, the heat enable signal 302 has a HIGH pulse width T1' (T1>T1') and a LOW pulse width T2' (T2'>T2). In this manner, the HIGH period is shorter in the OFF sequence than in print operation, and the LOW period is longer. This can suppress the amount of heat generated by the electrothermal transducer of the printhead 300, ensure a long head cooling period, and prevent ink discharge. The relation between T1 and T1' can be set to, e.g., T1'/T1=⅓.

The above-described pulse width may be stored in a memory in advance in accordance with the type of printhead such as a monochrome or color printhead. When the printhead is to be exchanged, the type of printhead is automatically determined, and a corresponding pulse width is read out from the memory and used.

Figure 9:
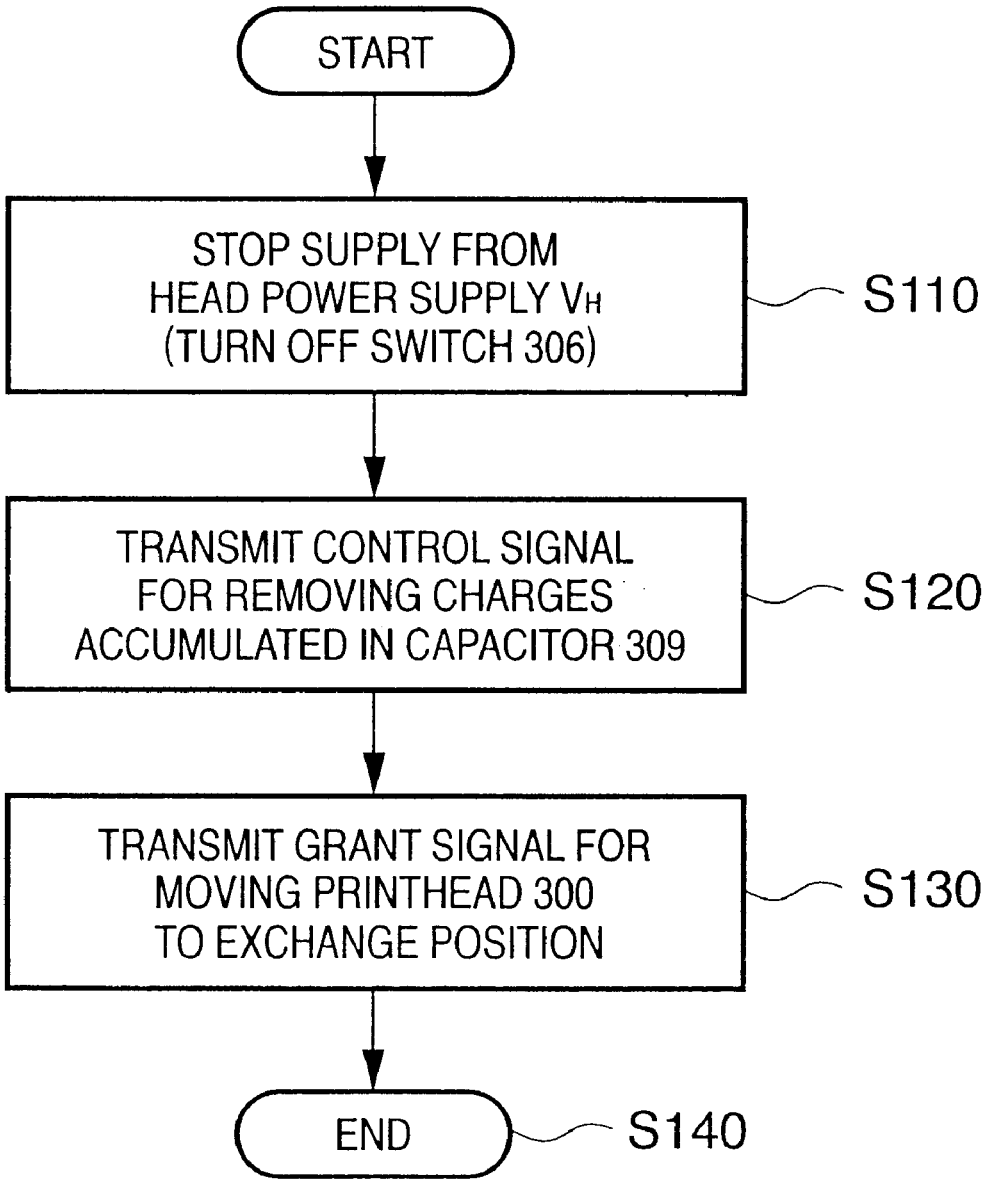
FIG. 9 is a flow chart showing a discharge method using the discharge circuit in the first embodiment.

[Method of Reducing Drive Voltage: FIG. 9]

FIG. 9 is a flow chart showing an example of a method of reducing the drive voltage after stopping supply of the drive voltage shown in FIGS. 8A and 8B. The processing in FIG. 9 is performed under the control of the CPU (E1001).

In step S110, after image printing ends, the CPU (E1001) designates to turn off the head power switch 306 and stop power supply from the head power $V_H$ (E1039). In step S120, the CPU (E1001) designates to transmit to the printhead a control signal (discharge circuit ON signal) for driving the print element 307 for a preset time (or a control signal of a predetermined number of pulses).

In step S130, upon the lapse of the preset time, the CPU (E1001) transmits a grant signal for moving the printhead to an exchange position, and advances to step S140 to end a series of processes.

<Second Embodiment>

An ink-jet printer according to the second embodiment will be described. The overall arrangement of the ink-jet printer in the second embodiment, the internal arrangement of the printed circuit board of the ink-jet printer, the drive circuit of the print element of the printhead of the ink-jet printer, the relationship between the head control signal of the printhead and the nozzle number of the printhead, and the drive timing of the drive circuit, none of which are shown, are almost the same as those in the first embodiment shown in FIGS. 1 to 5.

In the following description, a repetitive description of the same arrangement of the ink-jet printer in the second embodiment as that in the first embodiment will be omitted, and only the difference will be explained.

The first embodiment discharges by supplying a heat enable signal (HE) with a predetermined pulse width, and controls the voltage $V_C$ of the capacitor 309 so it reaches a set value or less faster than spontaneous discharge after the head power supply $V_H$ is turned off. In order to further ensure discharge executed in the first embodiment, the second embodiment adopts feedback control of discharging while monitoring the voltage of the capacitor 309 until the voltage reaches a set value or less after discharge.

Figure 10:
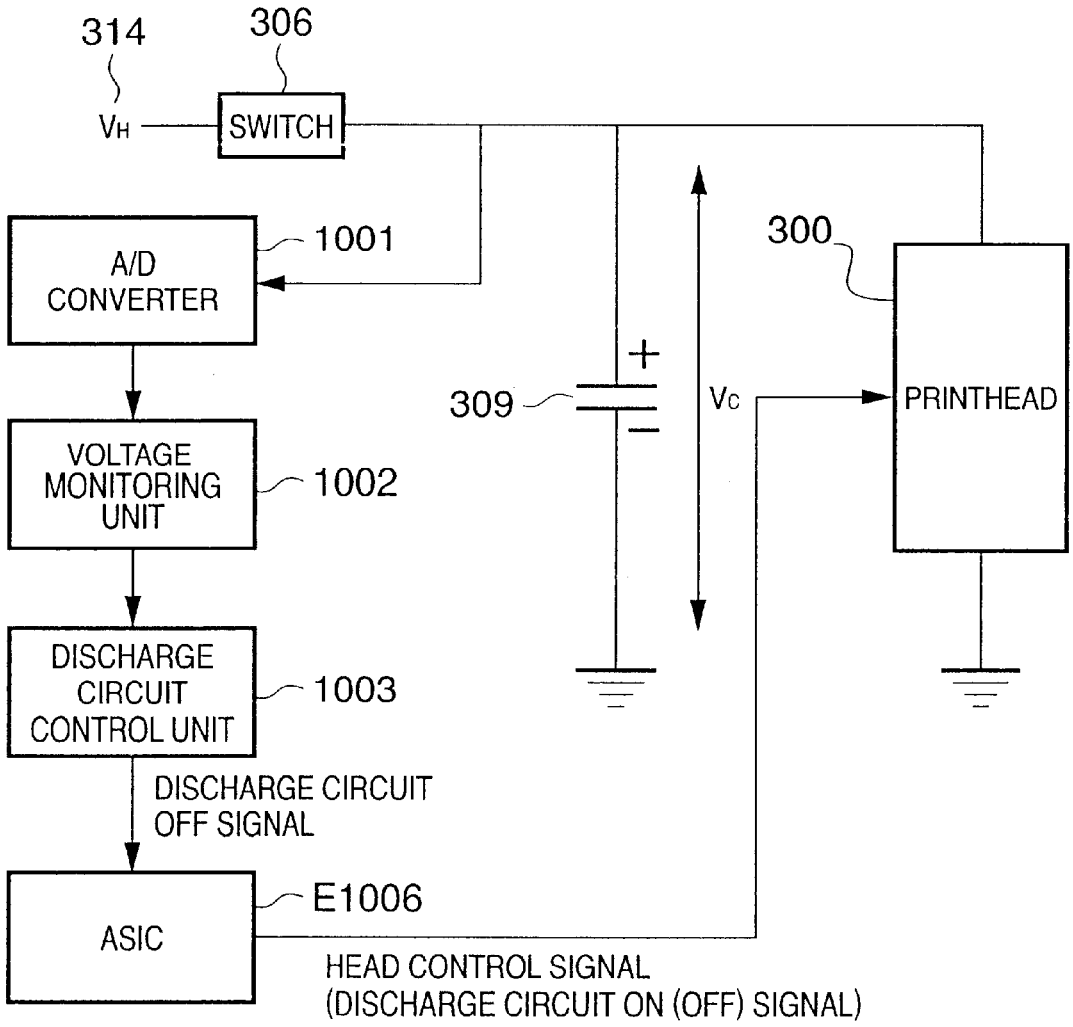
FIG. 10 is a block diagram for explaining an arrangement for removing charges accumulated in the capacitor 309 in the second embodiment.

[Reduction in Drive Voltage After Supply of Drive Voltage Stops: FIG. 10]

More specifically, as shown in FIG. 10, the second embodiment comprises a voltage monitoring unit which monitors the voltage $V_C$ of a capacitor 309 of a printhead 300, and a discharge circuit control unit which transmits a discharge circuit OFF signal for stopping a head control signal (E1021) from an ASIC (E1006) when the voltage monitored by the voltage monitoring unit reaches a set voltage or less.

Figure 11:
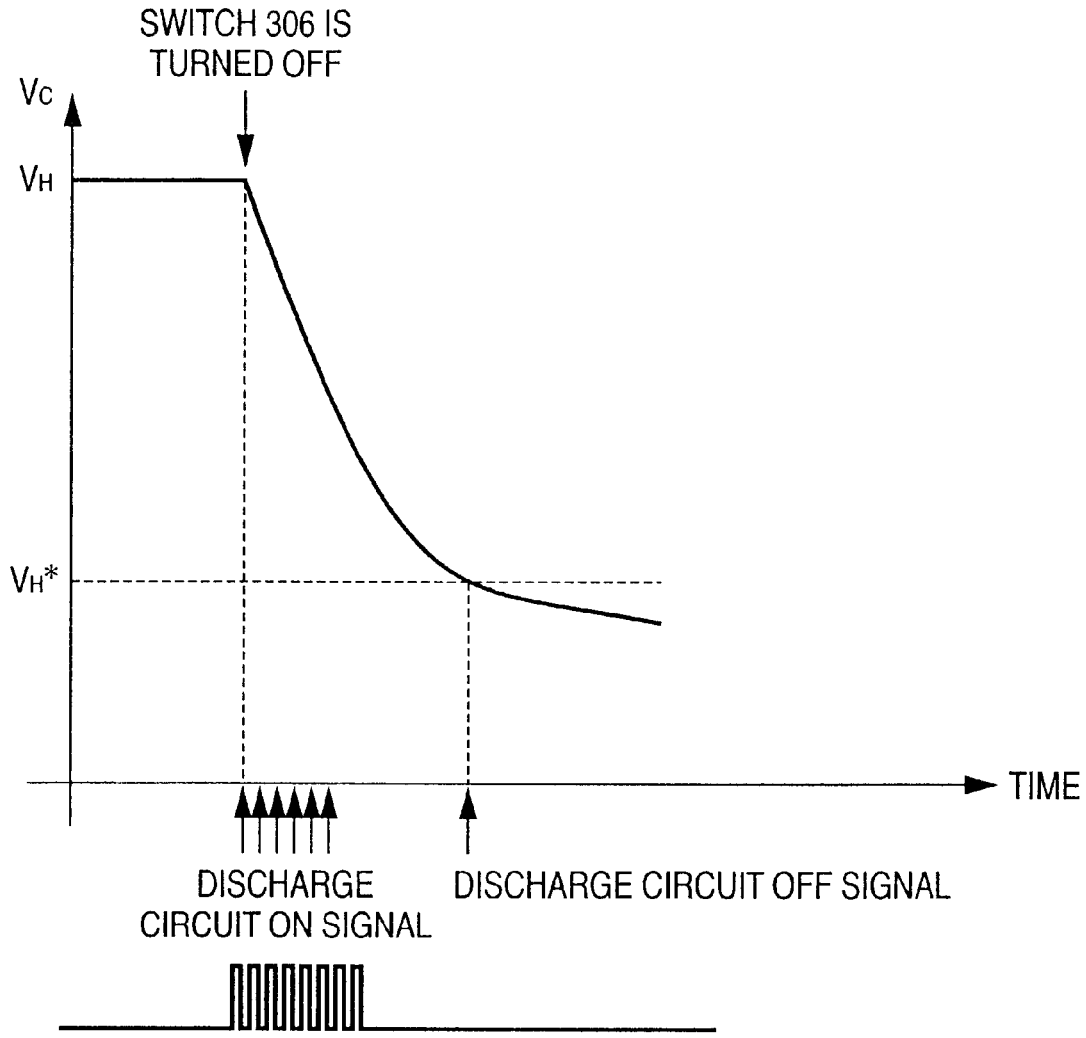
FIG. 11 is a graph for explaining the relationship between the capacitor voltage $V_C$ and the time when accumulated charges are removed using a discharge circuit in the second embodiment.

After image printing ends, a CPU (E1001) stops power supply from the head power supply to the printhead 300. The CPU (E1001) continuously supplies to the printhead a short-pulse-width heat enable signal described in the first embodiment as a discharge circuit ON signal as shown in FIG. 11 in order to remove charges accumulated in the capacitor 309. The CPU (E1001) drives a print element by using charges accumulated in the capacitor, thus starting discharge. The voltage monitoring unit monitors the voltage $V_C$ of the capacitor 309 that is converted by an A/D transducer, and notifies the discharge circuit control unit of the signal. When $V_C$ monitored by the voltage monitoring unit reaches $V_H$* (preset voltage) or less, the discharge circuit control unit transmits the discharge circuit OFF signal to the ASIC (E1006). Upon reception of the discharge circuit OFF signal, the ASIC (E1006) stops transmission of the head control signal (E1021) to the printhead 300. Under this control, the voltage $V_C$ of the capacitor 309 can be reliably reduced to a set voltage or less within a short time, thereby shortening the OFF sequence time.

Figure 12:
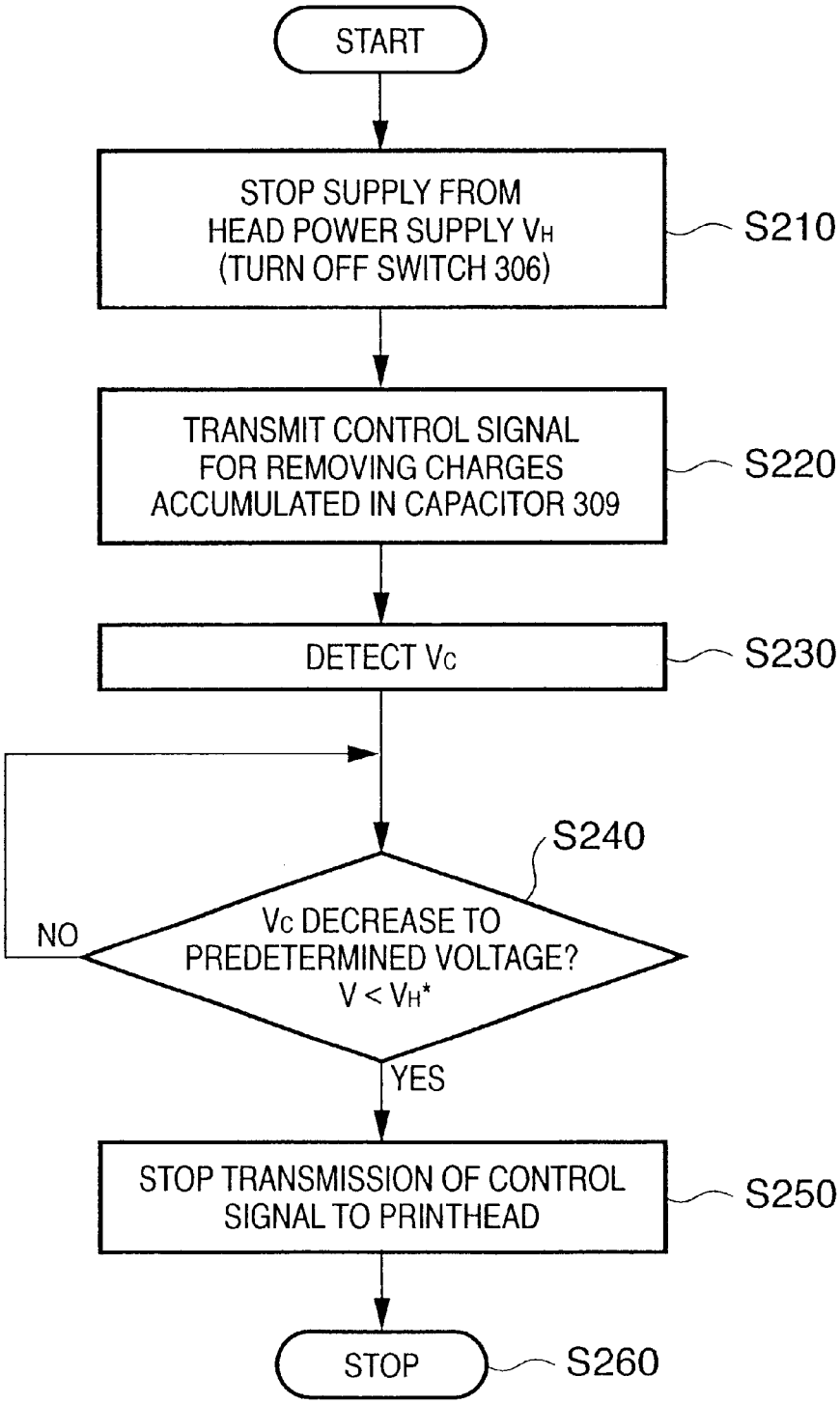
FIG. 12 is a flow chart showing a method of removing charges accumulated in the capacitor 309 by using the discharge circuit in the second embodiment.

[Method of Reducing Drive Voltage: FIG. 12]

FIG. 12 is a flow chart showing a method of reducing the drive voltage after stopping power supply from the head power supply $V_H$, as shown in FIG. 11. The processing in FIG. 12 is performed under the control of the CPU (E1001).

In step S210, after image printing ends, the CPU (E1001) designates to turn off a head power switch 306 and stop power supply from the head power $V_H$.

In step S220, the CPU (E1001) instructs the ASIC (E1006) to transmit to the printhead the head control signal E1021 (discharge circuit ON signal) for driving the print element in order to reduce the voltage (capacitor voltage $V_C$) of the capacitor 309.

In step S230, the CPU (E1001) detects the capacitor voltage $V_C$, and checks whether the capacitor voltage $V_C$ has decreased to a preset voltage level ($V_H$*).

If it is determined in step S240 that the detected capacitor voltage $V_C$ has not decreased to the preset voltage level ($V_H$*), the CPU (E1001) waits until the capacitor voltage $V_C$ decreases to $V_H$*. If the detected capacitor voltage $V_C$ has decreased to this level, the CPU (E1001) advances to step S250.

In step S250, the CPU (E1001) transmits a discharge circuit OFF signal to the ASIC (E1006), and stops transmission of an OFF sequence control signal to the printhead. After the CPU (E1001) transmits a grant signal for moving the printhead to an exchange position, the CPU (E1001) shifts to step S260 to end a series of processes.

As has been described above, by using the ink-jet print apparatus described in above embodiments, the change of the voltage descent, which is the problem when the number of nozzles increases, can be decreased. As a result, (1) ink discharge is stable for any print image and the quality of the image is improved. (2) The print speed can be increased. (3) The durability of discharge heaters is increased. (4) Since the construction of the system is simplified, the cost for the system can be cut down.

As has been described above, the present invention can provide an image print apparatus capable of quickly reducing, with a low-cost arrangement, charges accumulated in an electrolytic capacitor serving as a means for reducing variations in printhead voltage, and a control method thereof.

In this specification, "print" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, a "printing medium" not only includes a paper sheet used in common printing apparatuses, but also broadly includes materials, such as cloth, a plastic film, a metal plate, glass, ceramics, wood, and leather, capable of accepting ink.

Furthermore, "ink" (to be also referred to as a "liquid" hereinafter) should be extensively interpreted similar to the definition of "print" described above. That is, "ink" includes a liquid which, when applied onto a printing medium, can form images, figures, patterns, and the like, can process the printing medium, and can process ink (e.g., can solidify or insolubilize a coloring agent contained in ink applied to the printing medium).

In the description of the above embodiment, a liquid droplet discharged from the printhead is ink, and the liquid stored in the ink tank is also ink. However, the liquid stored in the ink tank is not limited to ink. For example, the ink tank may store a processed liquid to be discharged onto a print medium so as to improve fixability and water repellency of a printed image or to improve its image quality.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand and continuous type systems. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention.

In addition, not only a cartridge type printhead in which an ink tank is integrally arranged on the printhead itself but also an exchangeable chip type printhead, as described in the above embodiment, which can be electrically connected to the apparatus main unit and can receive an ink from the apparatus main unit upon being mounted on the apparatus main unit can be applicable to the present invention.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program. In this case, the program codes read from the storage medium realize the functions according to the embodiments, and the storage medium storing the program codes constitutes the invention. Furthermore, besides the aforesaid functions according to the above embodiments being realized by executing the program codes which are read by a computer, the present invention includes a case where an OS (operating system) or the like working on the computer performs a part of or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or entire processes in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. An image print apparatus which has a printhead with a plurality of print elements, and an image print unit for printing an image by driving the plurality of print elements on the basis of input image data, comprising:

a voltage supply unit for supplying a drive voltage for driving the plurality of print elements;

a voltage variation reducing unit for reducing variations in the drive voltage which varies in accordance with the number of print elements to be driven; and a voltage controller for controlling the image print unit so as to reduce the drive voltage remaining in said voltage variation reducing unit after supply of the drive voltage is stopped.

2. The apparatus according to claim 1, wherein said voltage controller reduces a voltage remaining in said voltage variation reducing unit by controlling the image print unit so as to transmit a drive signal having a predetermined pulse width for driving the print elements.

3. The apparatus according to claim 2, wherein the drive signal includes a signal which is small enough not to print an image.

4. The apparatus according to claim 1, wherein the apparatus further comprises a monitoring unit for monitoring the voltage supplied to the printhead, and a drive signal stop unit for controlling said voltage controller, said voltage controller controls the image print unit so as to transmit a drive signal for driving the print elements, and said drive signal stop unit controls said voltage controller so as to stop transmission of the drive signal on the basis of the voltage monitored by said monitoring unit.

5. The apparatus according to claim 4, wherein said drive signal stop unit controls to stop transmission of the drive signal when the voltage monitored by said monitoring unit reaches not more than a predetermined voltage.

6. The apparatus according to claim 1, wherein the printhead comprises an ink-jet printhead that prints by discharging ink.

7. The apparatus according to claim 1, wherein the drive voltage is supplied to heat the printhead.

8. The apparatus according to claim 1, wherein said voltage variation reducing unit includes a capacitor.

9. The apparatus according to claim 1, wherein the printhead comprises a printhead which discharges ink by using thermal energy, and each print element comprises an electrothermal transducer for generating thermal energy to be applied to the ink.

10. A method of controlling an image print apparatus which has a printhead with a plurality of print elements, and an image print unit for printing an image by driving the plurality of print elements on the basis of input image data, said method comprising:

a voltage supply step of supplying a drive voltage for driving the plurality of print elements;

a voltage variation reducing step of reducing variations in the drive voltage which varies in accordance with the number of print elements to be driven; and a voltage control step of controlling the image print unit so as to reduce the drive voltage remaining in the voltage variation reducing step after supply of the voltage is stopped.

11. The method according to claim 10, wherein in the voltage control step, a voltage remaining in the voltage variation reducing step is reduced by controlling the image print unit so as to transmit a drive signal having a predetermined pulse width for driving the print elements.

12. The method according to claim 11, wherein the drive signal includes a signal that is small enough not to print an image.

13. The method according to claim 10, wherein the method further comprises a monitoring step of monitoring the voltage supplied to the printhead, and a drive signal stop step of controlling the voltage control step, in said voltage control step, the image print unit is so controlled as to transmit a drive signal for driving the print elements, and in said drive signal stop step, the voltage control step is so controlled as to stop transmission of the drive signal on the basis of the voltage monitored in the monitoring step.

14. The method according to claim 13, wherein in said drive signal stop step, transmission of the drive signal is so controlled as to be stopped when the voltage monitored in said monitoring step reaches not more than a predetermined voltage.

15. The method according to claim 10, wherein the printhead comprises an ink-jet printhead which prints by discharging ink.

16. The method according to claim 10, wherein the drive voltage is supplied to heat the printhead.

17. The method according to claim 10, wherein in said voltage variation reducing step, variations in the drive voltage are reduced using a capacitor.

18. The method according to claim 10, wherein the printhead comprises a printhead which discharges ink by using thermal energy, and each print element comprises an electrothermal transducer for generating thermal energy to be applied to the ink.

19. A control program of controlling an image print apparatus which has a printhead with a plurality of print elements, and an image print unit for printing an image by driving the plurality of print elements on the basis of input image data, comprising:

a voltage supply step of supplying a drive voltage for driving the plurality of print elements;

a voltage variation reducing step of reducing variations in the drive voltage which varies in accordance with the number of print elements to be driven; and a voltage control step of controlling the image print unit so as to reduce the drive voltage remaining in the voltage variation reducing step after supply of the voltage is stopped.

20. A computer-readable storage medium which stores a control program of controlling an image print apparatus which has a printhead with a plurality of print elements, and an image print unit for printing an image by driving the plurality of print elements on the basis of input image data, wherein the control program comprises:

a voltage supply step of supplying a drive voltage for driving the plurality of print elements;

a voltage variation reducing step of reducing variations in the drive voltage which varies in accordance with the number of print elements to be driven; and a voltage control step of controlling the image print unit so as to reduce the drive voltage remaining in the voltage variation reducing step after supply of the voltage is stopped.

* * * * *